US007456753B2

(12) United States Patent
Kitagawa et al.

(10) Patent No.: US 7,456,753 B2
(45) Date of Patent: Nov. 25, 2008

(54) INTERNAL PRESSURE EXPLOSION-PROOF SYSTEM

(75) Inventors: Teruhisa Kitagawa, Kitakyushu (JP); Shingi Takahashi, Kitakyushu (JP)

(73) Assignee: Kabushiki Kaisha Yaskawa Denki, Kitakyushu-shi (JP)

( * ) Notice: Subject to any disclaimer, the term of this patent is extended or adjusted under 35 U.S.C. 154(b) by 290 days.

(21) Appl. No.: 11/406,514

(22) Filed: Apr. 19, 2006

(65) Prior Publication Data

US 2006/0250025 A1 Nov. 9, 2006

(30) Foreign Application Priority Data

Apr. 20, 2005 (JP) ..... 2005-121821
Apr. 3, 2006 (JP) ..... 2006-101374

(51) Int. Cl.
*G08B 21/00* (2006.01)

(52) U.S. Cl. ..... 340/614; 340/501; 340/532; 340/611; 340/632; 340/680; 340/623; 901/1; 901/23; 901/40; 901/43; 901/49

(58) Field of Classification Search ..... 340/614, 340/626, 632, 633, 501, 532, 611, 680, 623; 228/218–221, 235.1; 700/282, 258; 901/1, 901/23, 40, 43, 49; 74/218–221, 235.1
See application file for complete search history.

(56) References Cited

U.S. PATENT DOCUMENTS 4,298,955 A * 11/1981 Munday et al. ..... 700/266
4,668,146 A * 5/1987 Ageta ..... 414/4
4,712,736 A * 12/1987 Bray et al. ..... 239/11
4,866,594 A * 9/1989 David et al. ..... 700/9
4,984,745 A * 1/1991 Akeel et al. ..... 239/587.2
4,985,653 A * 1/1991 Takagi et al. ..... 310/88
6,094,142 A * 7/2000 Lu ..... 340/626
6,477,913 B1 * 11/2002 Akeel et al. ..... 74/490.03
6,783,054 B1 * 8/2004 Pregeant et al. ..... 228/102

* cited by examiner

*Primary Examiner*—George A Bugg
*Assistant Examiner*—Son M Tang
(74) *Attorney, Agent, or Firm*—Westerman, Hattori, Daniels & Adrian, LLP.

(57) ABSTRACT

An internal pressure explosion-proof system is provided that is capable of detecting high-pressure abnormality of an internal pressure explosion-proof mechanism, urging a check of gas/air apparatus by providing a means for notifying a user of abnormality, and decreasing excessive pressure of an internal pressure chamber. A high-pressure abnormality detector and a pressure regulating valve are provided in an air discharging portion for releasing the gas/air discharged from the internal pressure explosion-proof mechanism. The working pressure of the high-pressure abnormality detector is set to be lower than the working pressure of the pressure regulating valve. The high-pressure abnormality detector sends a signal when the pressure becomes higher than the set pressure to make the alarm give a warning and makes the open valves open to decrease the pressure of the internal pressure chamber of the internal pressure explosion-proof mechanism which became excessive.

6 Claims, 12 Drawing Sheets

INTERNAL PRESSURE EXPLOSION-PROOF SYSTEM

This application claims priority under 35 U.S.C. §119 to Japanese Patent Application No. 2005-121821 filed on Apr. 20, 2005, the entire disclosure of which is incorporated herein by reference in its entirety.

BACKGROUND OF THE INVENTION

1. Field of the Invention

The present invention relates to an internal pressure explosion-proof system, and some preferred embodiments relate to an internal pressure explosion-proof system preferably used as a robot system capable of detecting internal high pressure abnormality.

2. Description of Related Art

The following description sets forth the inventor's knowledge of related art and problems therein and should not be construed as an admission of knowledge in the prior art.

An internal pressure explosion-proof system equipped with an inactive-gas/air supplying portion and an inactive-gas/air discharging portion is known. See for example, Japanese Patent No. 2796482 (hereinafter referred to as "Patent Document 1"). According to this known design, an internal pressure of an internal pressure explosion-proof mechanism is monitored by a pressure detector, and a signal is sent to a protection monitoring device. The protection monitoring device is connected to a control apparatus of an internal pressure explosion-proof mechanism. If the internal pressure of the internal pressure explosion-proof mechanism in normal operation becomes lower than a predetermined value, the pressure detector detects the pressure drop and sends a signal to the protection monitoring device, and the control apparatus shuts down the power supply to the internal pressure explosion-proof mechanism upon receipt of the signal from the protection monitoring device.

On the other hand, in a purging work which should be done at the time of the startup of the internal pressure explosion-proof mechanism, the pressure detector sends a signal to the protection monitoring device if the internal pressure of the internal pressure explosion-proof mechanism becomes higher than a predetermined value. In this protection monitoring device, a timer is activated upon receipt of the signal and counts a time period during which the inactive-gas/air supplying portion can send inactive-gas/air of 5 times or more of the internal volume of the internal pressure explosion-proof mechanism. The abnormal detection of the internal pressure at the time of the normal operation and the method of the purging work are disclosed in the column of the prior art of Patent Document 1. In the invention disclosed by this patent, especially, for the purpose of simplifying the structure of the inactive-gas/air supplying portion and the inactive-gas/air discharging portion, it is configured to excite the electromagnetic valve for discharging the inactive-gas/air by the electric power sent to the internal pressure explosion-proof mechanism.

An internal pressure explosion-proof system equipped with an inactive-gas/air discharging portion is also known by Japanese Unexamined Laid-open Patent Publication No. 2003-62787 (hereinafter referred to as "Patent Document 2"). In this design, the inactive-gas/air discharging portion is provided with a main piping for releasing the inactive-gas/air discharged from the internal pressure explosion-proof mechanism, and the reserve piping formed in parallel with the main piping separately is formed. When the internal pressure explosion-proof mechanism becomes abnormally high in internal pressure for some reasons, the inactive-gas/air is released from a valve provided to the reserve piping to decrease the pressure of the internal pressure explosion-proof mechanism, to thereby to protect the inactive-gas/air discharging portion provided in the main piping.

The invention proposed by Patent Document 1 or the prior art technique disclosed in Patent Document 1 fail to disclose any means or solution to cope with the case in which the internal pressure explosion-proof mechanism is increased in internal pressure due to, e.g., troubles of the inactive-gas/air supplying portion, etc., not during the purging operation but during the normal operation.

Furthermore, in the invention disclosed by Patent Document 2, although the inactive-gas/air is released automatically when the internal pressure explosion-proof mechanism is increased in internal pressure and therefore the pressure of the reserve piping provided separately from the main piping becomes higher than a predetermined pressure, no means for warning a user the high-pressure abnormality is provided. In other words, in the invention disclosed by Patent document 2, a spare discharging piping is required apart from the main piping. Furthermore, the pressure in the internal pressure explosion-proof mechanism is decreased automatically, and since no means for notifying it of a user, the user cannot recognize the abnormality. In other words, no means for urging the maintenance and/or repair check was available, causing unnecessary releasing of the inactive-gas/air, which in turn becomes loads to the supplying source (e.g., compressor) of the inactive-gas/air.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments provide an internal pressure explosion-proof system capable of detecting high-pressure abnormality of an internal pressure explosion-proof mechanism and notifying a user of the detected high-pressure abnormality.

According to one aspect of the present invention, an internal pressure explosion-proof system includes an internal pressure explosion-proof mechanism to be installed in a hazardous atmosphere, wherein the internal pressure explosion-proof mechanism has an internal pressure chamber to which inactive-gas/air is supplied. It also includes a control apparatus installed in a non-hazardous atmosphere to control the internal pressure explosion-proof mechanism, an inactive-gas/air supplying portion configured to supply inactive-gas/air to the internal pressure explosion-proof mechanism, an inactive-gas/air discharging portion configured to release the inactive-gas/air discharged from the internal pressure explosion-proof mechanism, a high-pressure abnormality detector configured to send a signal to the control apparatus when an internal pressure of the internal pressure explosion-proof mechanism becomes higher than a predetermined pressure, and an alarm configured to give warning when the signal of the high-pressure abnormality of the high-pressure abnormality detector is received.

With this internal pressure explosion-proof system, for example, high-pressure abnormality of the internal pressure explosion-proof mechanism can be detected, and the high-pressure abnormality can be notified to a user. Furthermore, excessive internal pressure can be reduced by releasing the inactive-gas/air. This allows immediate recognition of the abnormality by the user, and results in a quick check of the inactive-gas/air apparatus, etc. Moreover, the inactive-gas/air apparatus and/or the internal pressure explosion-proof mechanism can be prevented from being damaged by high pressure. Accordingly, stable operation of the internal pressure explosion-proof system can be realized.

Further, in the internal pressure explosion-proof system, the high-pressure abnormality detector can be provided in the discharging portion.

Further, in the internal pressure explosion-proof system, the alarm can be equipped in the control apparatus.

Further, in the internal pressure explosion-proof system, the high-pressure abnormality detector can be a pressure detector.

Further, in the internal pressure explosion-proof system, the high-pressure abnormality detector can be a flow detector.

Further, in the internal pressure explosion-proof system, the high-pressure abnormality detector can be a pressure regulating valve equipped with a switch which releases inactive-gas/air and sends a signal when detected pressure reaches a predetermined value or above.

Further, in the internal pressure explosion-proof system, it is preferable that the control apparatus makes the alarm generate a warning and also makes the inactive-gas/air discharging portion release inactive-gas/air in the internal pressure explosion-proof mechanism when the control apparatus receives the signal of the high-pressure abnormality from the high-pressure abnormality detector.

In the internal pressure explosion-proof system, the internal pressure explosion-proof mechanism can be a robot.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE INVENTION

In the following paragraphs, some preferred embodiments of the invention will be described by way of example and not limitation. It should be understood based on this disclosure that various other modifications can be made by those in the art based on these illustrated embodiments.

Figure 2:
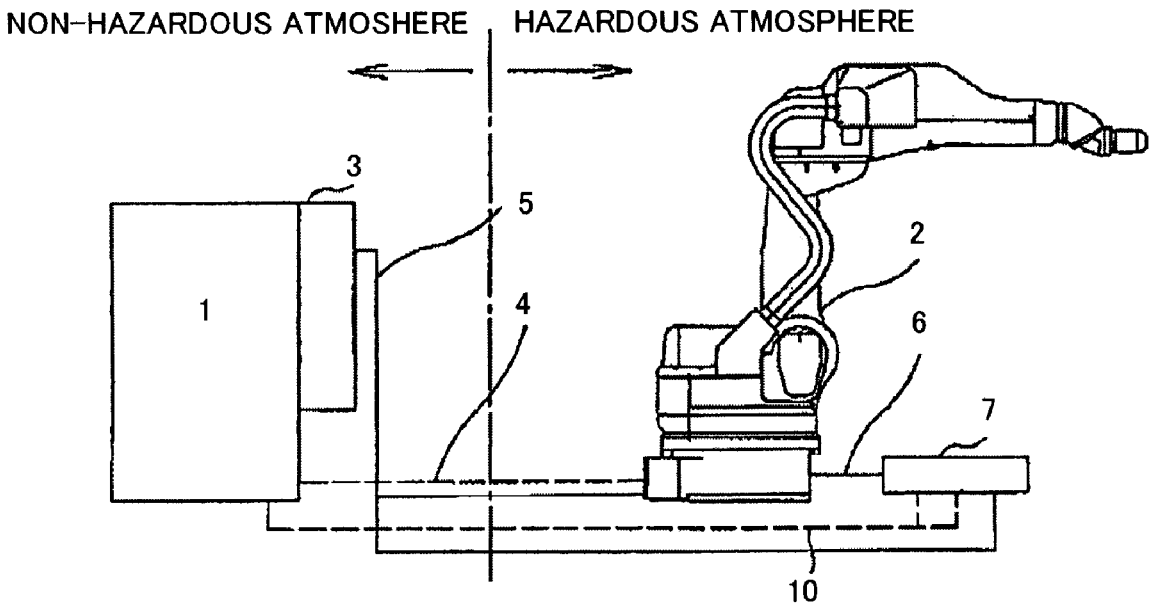
FIG. 2 is a schematic view showing the internal pressure explosion-proof system according to the embodiment of the present invention.

FIG. 2 is a schematic view showing an example paint robot system using the internal pressure explosion-proof system according to an embodiment of the present invention. In FIG. 2, the reference numeral "1" denotes a control apparatus, "2" denotes a manipulator having an internal pressure chamber therein, "3" denotes an inactive-gas/air supplying portion for supplying inactive-gas/air to the internal pressure chamber, "4" denotes a control cable for connecting the control apparatus 1 and the manipulator 2, "5" denotes an inactive-gas/air piping for connecting the inactive-gas/air supplying portion 3 and the manipulator 2, "6" denotes an inactive-gas/air piping into which the inactive-gas/air discharged from the manipulator 2 is introduced, and "7" denotes an inactive-gas/air discharging portion to which the inactive-gas/air piping 6 is connected.

The manipulator 2 and the inactive-gas/air discharging portion 7 are installed in a hazardous atmosphere partitioned, for example, by a partition wall in which the control cable 4 and the inactive-gas/air piping 5 is penetrated. Other apparatuses other than the above, such as the control apparatus 1 and the inactive-gas/air supplying portion 3, are installed in a non-hazardous atmosphere.

In the above structure, the control apparatus 1 controls the manipulator 2 through the control cable 4.

To maintain a pressure of the internal pressure chamber in the manipulator 2 so as to be higher than the atmospheric pressure of the hazardous atmosphere, inactive-gas/air is introduced into the internal pressure chamber via the inactive-gas/air piping 5 from the inactive-gas/air supplying portion 3. The introduced inactive-gas/air is discharged from the inactive-gas/air discharging portion 7 to the atmosphere.

Figure 1:
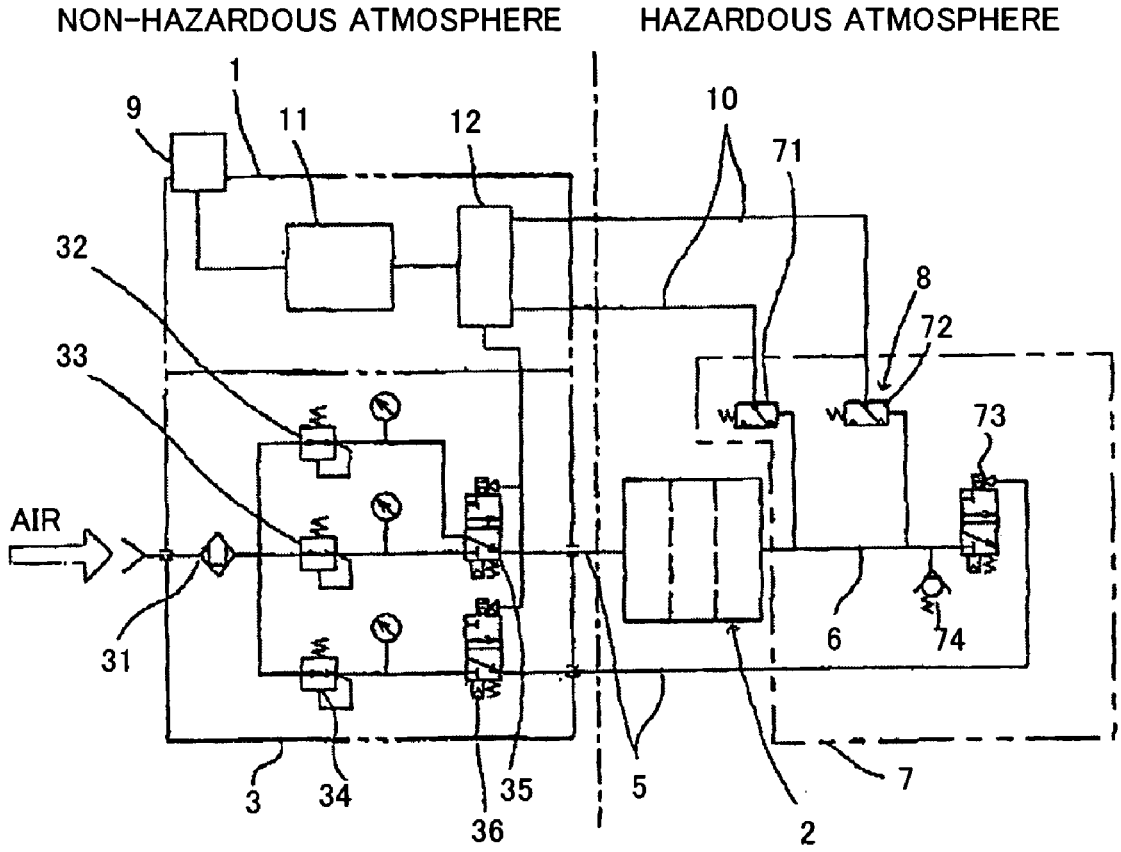
FIG. 1 is block diagram showing an internal pressure explosion-proof system according to the embodiment of the present invention.

FIG. 1 is a block diagram showing the inactive-gas/air supplying portion 3 and the inactive-gas/air discharging portion 7 shown in FIG. 2.

As shown in FIG. 1, the inactive-gas/air supplying portion 3 is provided with a filter 31 which allows the passing of the inactive-gas/air supplied from the supply source (not shown) of the inactive-gas/air, and pressure regulators 32, 33, and 34, and supplies inactive-gas/air regulated in pressure to the manipulator 2 and the inactive-gas/air discharging portion 7 via the inactive-gas/air piping 5 by the combination of operations of the electromagnetic valves 35 and 36. Here, the inactive-gas/air supplied to the inactive-gas/air discharging portion 7 operates the open valve 73 which is described below. The electromagnetic valves 35 and 36 are operated by electrical signals from the control apparatus 1.

The pressure of the inactive-gas/air introduced from the inactive-gas/air supply source is decompressed into a common pressure with the pressure regulator 32, and is decompressed into a purging pressure with the pressure regulator 33. Therefore, the inactive-gas/air to be supplied to the manipulator 2 is changed into a normal pressure and a purging pressure through the electromagnetic valve 35. The purging pressure is adjusted so as to be higher than the normal pressure. In the same manner, the pressure of the inactive-gas/air introduced from the inactive-gas/air supply source is decompressed with the pressure regulator 34 to a pressure which operates the open valve 73.

On the other hand, the inactive-gas/air discharging portion 7 is equipped with a pressure detector 71 in the middle portion of the inactive-gas/air piping 6 for introducing the inactive-gas/air discharged from the manipulator 2. Also equipped in the middle portion of the inactive-gas/air piping 6 are a pressure detector 72 portion which is a high-pressure abnormality detector and a pressure regulating valve 74. At the end of the piping 6, an open valve 73 is equipped. This open valve 73 is operated by the inactive-gas/air supplied by the inactive-gas/air piping 5.

The pressure detector 71 sends a signal to the control apparatus 1 when the pressure of the inactive-gas/air flowing through the inactive-gas/air piping 6 becomes lower than the set pressure. The set pressure of the pressure detector 71 is set to be slightly lower than a normal pressure. The pressure detector 72 sends a signal to the control apparatus 1 when the inactive-gas/air flowing through the inactive-gas/air piping 6 becomes higher than the set pressure. The set pressure of the pressure detector 72 is set to be slightly higher than the normal pressure. The pressure regulating valve 74 is opened automatically mechanically when the inactive-gas/air flowing through the inactive-gas/air piping 6 becomes higher than the set pressure to release the inactive-gas/air into the atmosphere. The set pressure for activating the pressure regulating valve 74 is set to be slightly higher than the set pressure of the pressure detector 72. The open valve 73 is activated when inactive-gas/air is supplied from the inactive-gas/air piping 6, to release the inactive-gas/air flowing through the inactive-gas/air piping 6 into the atmosphere.

The control apparatus 1 is equipped with at least an I/O unit 12 which receives the signal sent from the pressure detectors 71 and 72, a processing unit 11, such as a CPU, and an alarm 9. The I/O unit 12 is also connected to the electromagnetic valves 35 and 36 to control the operation thereof. The processing unit 11, or the CPU, is connected to the I/O unit 12 to exchange signals therebetween. The alarm 9 is, for example, a warning lamp or a buyer To notify the user of this system of abnormality in response to the signal of the high-pressure abnormality sent from the pressure detector 72, a warning lamp as the alarm 9, for example, is turned on through the I/O unit 12 and the processing unit 11. The alarm 9 is provided independently as mentioned above. Usually, a manual-operation system, such as a teaching pendant for manually operating the manipulator 2, is connected to the control apparatus 1. Thus, it can be considered that this warning is displayed on such a manual-operation system.

This embodiment is different from the previous system in that the pressure detector 72 is provided in the inactive-gas/air discharging portion 7 in addition to the pressure detector 71 and the alarm 9 is provided at the control apparatus 1 so as to notify a user of high-pressure abnormality by an abnormal signal from the pressure detector 72.

Now, the operation of the aforementioned system will be explained with reference to examples in the flowcharts shown in FIGS. 3A to 3D.

Figure 3A:
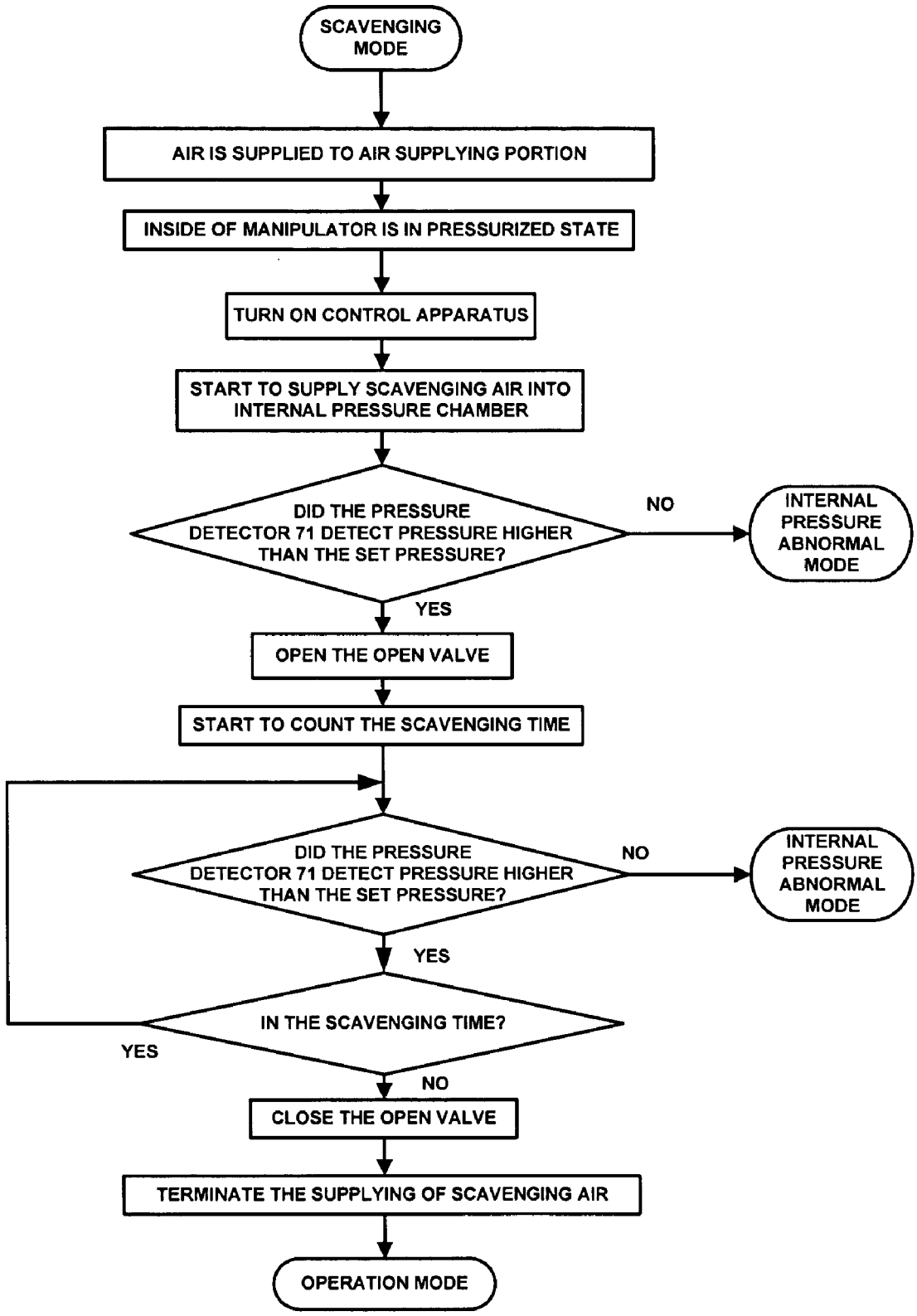
FIG. 3A is a flowchart showing an operation of the internal pressure explosion-proof system in a purging mode according to the first embodiment of the present invention.

First, an example of an operation in a purging mode is explained with reference to the flowchart shown in FIG. 3A. In this example, in order to scavenge the inside of the manipulator 2, the system is activated in the purging mode. Initially, inactive-gas/air is introduced into the inactive-gas/air supplying portion 3 from the inactive-gas/air supply source (not shown) to create a pressurized state (static pressure) of the manipulator 2. When the main power supply of the control apparatus 1 is turned on, the electromagnetic valve 35 shown in FIG. 1 is activated and purging inactive-gas/air will be supplied to the manipulator 2. The internal pressure of the manipulator 2 is detected by the pressure detector 71. If the internal pressure is below the set pressure, since sufficient pressure is not supplied in the internal pressure chamber, the routine proceeds to the abnormal mode. On the other hand, if a pressure higher than the set pressure is supplied, the open valve 73 is made to open and inactive-gas/or air is kept being supplied for a set period of purging time. At this time, the internal pressure is continuously detected by the pressure detector 71, and if the internal pressure becomes lower than the set pressure, the routine proceeds to the internal pressure abnormal mode. When the set purging time has passed, the open valve 73 is closed to terminate the supplying of purging inactive-gas/air, and the routine proceeds to the operation mode when the internal pressure becomes a static pressure.

Figure 3B:
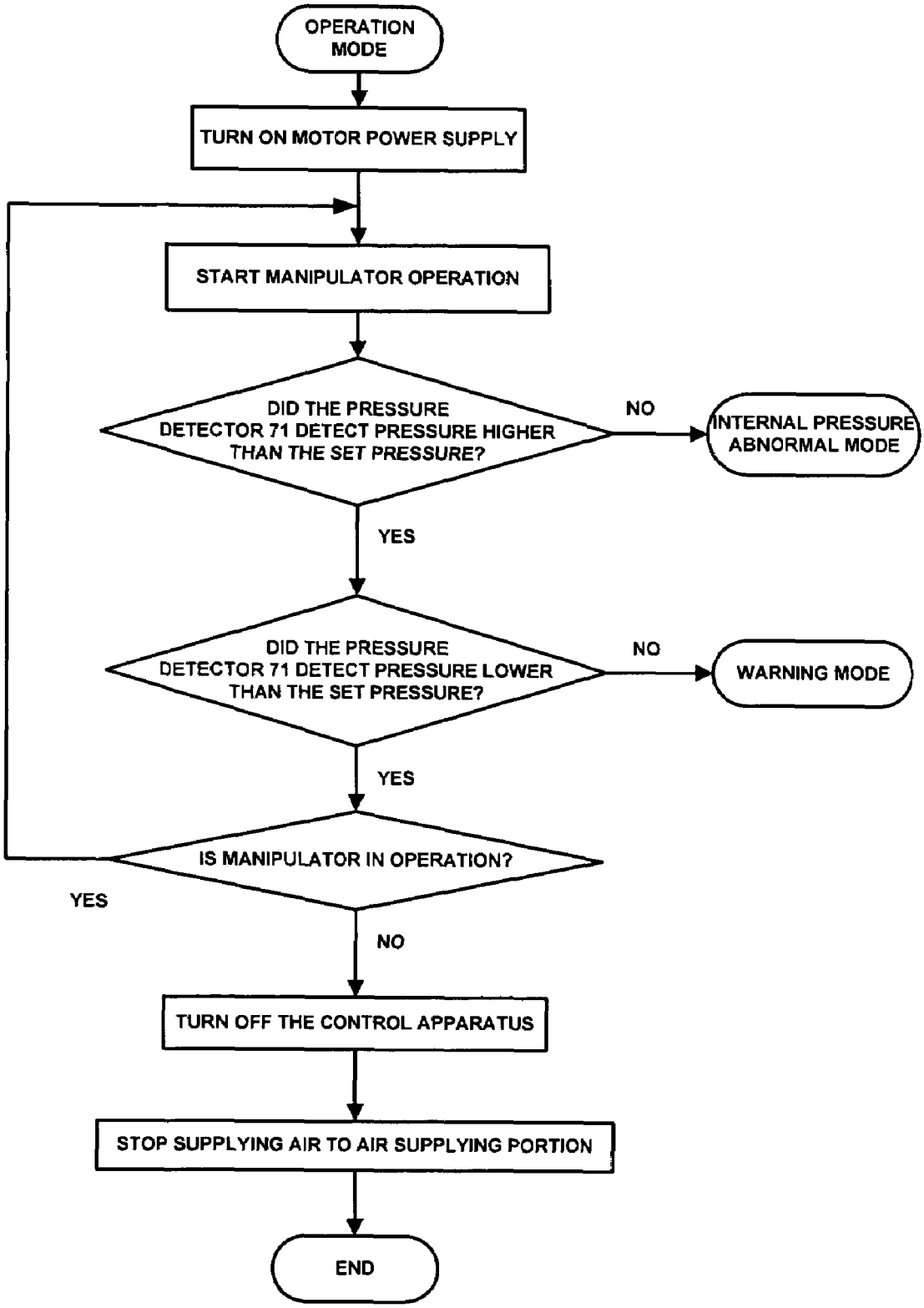
FIG. 3B is a flowchart showing an operation of the internal pressure explosion-proof system in an operation mode according to the first embodiment of the present invention.

Next, the operation mode example shown in FIG. 3B is explained. In the operation mode of this system, the motor power supply (not shown) in the manipulator 2 is turned on. When the manipulator 2 is in the operating condition, the pressure detector 71 detects the internal pressure. If the internal pressure becomes lower than the set pressure, the routine proceeds to the internal pressure abnormal mode. Simultaneously, the pressure detector 72 detects the internal pressure of the high-pressure abnormality detector. If the internal pressure becomes higher than the set pressure, the routine proceeds to a warning mode. When the operation of the manipulator 2 is terminated, the power source of the control apparatus 1 is turned off, and the supplying of the inactive-gas/air to the inactive-gas/air supplying portion 3 is shut down, and the operation mode terminates.

Figure 3C:
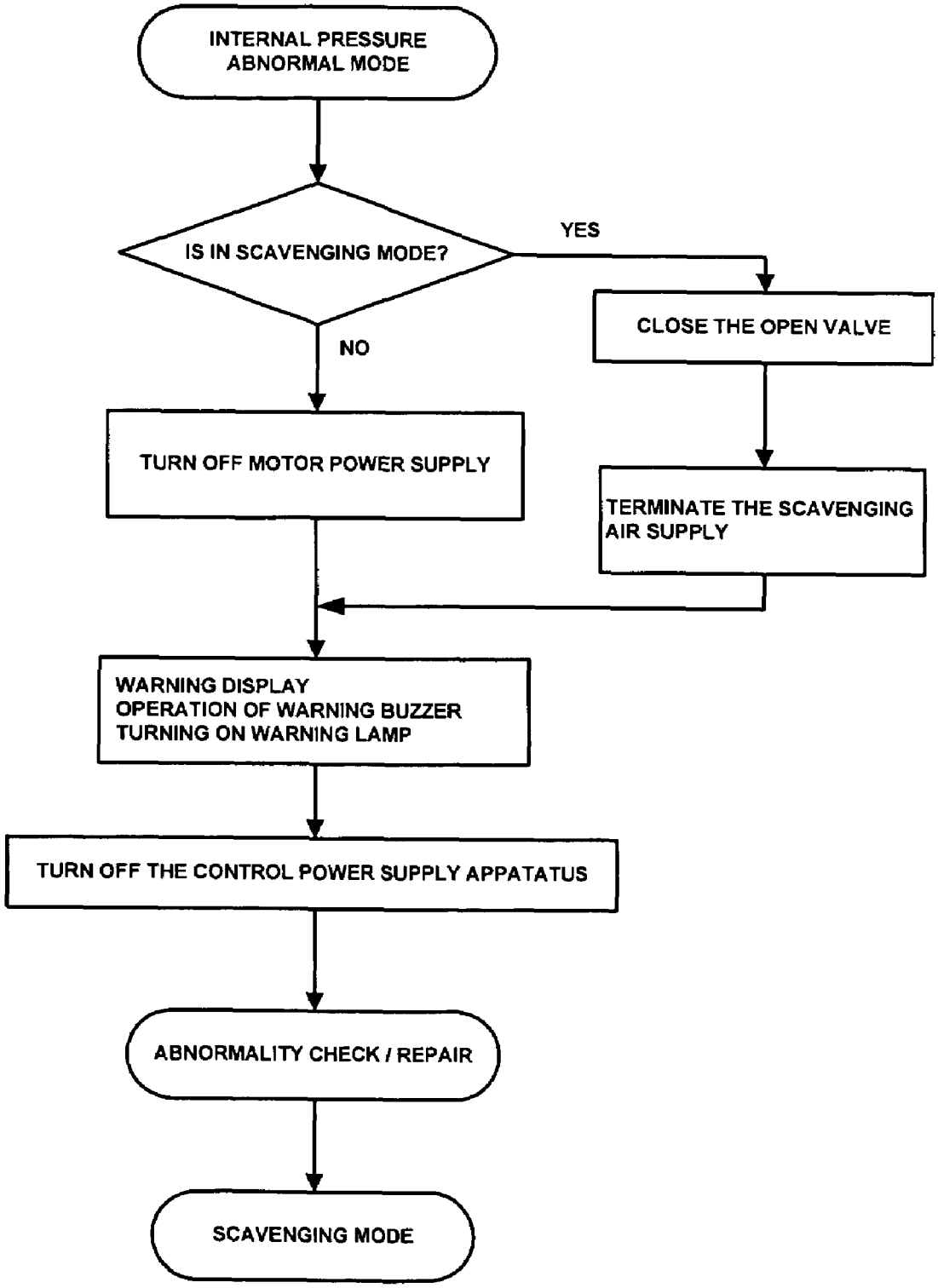
FIG. 3C is a flowchart showing an operation of the internal pressure explosion-proof system in an internal pressure abnormal mode according to the first embodiment of the present invention.

Next, an internal pressure abnormal mode is explained with reference to the flowchart shown in FIG. 3C. If the mode of the system shifts from the purging mode to the internal pressure abnormal mode, the open valve 73 is closed and the supplying of the purging inactive-gas/air is terminated. If the mode of the system shifts from the operation mode to the internal pressure abnormal mode, the motor power supply is turned off. Thereafter, the control apparatus 1 performs the abnormal display such as buzzer operation or lamp lighting. After turning off the power supply of the control apparatus 1 and performing the check of the abnormal cause and/or the repair, the routine proceeds to the purging mode again.

Figure 3D:
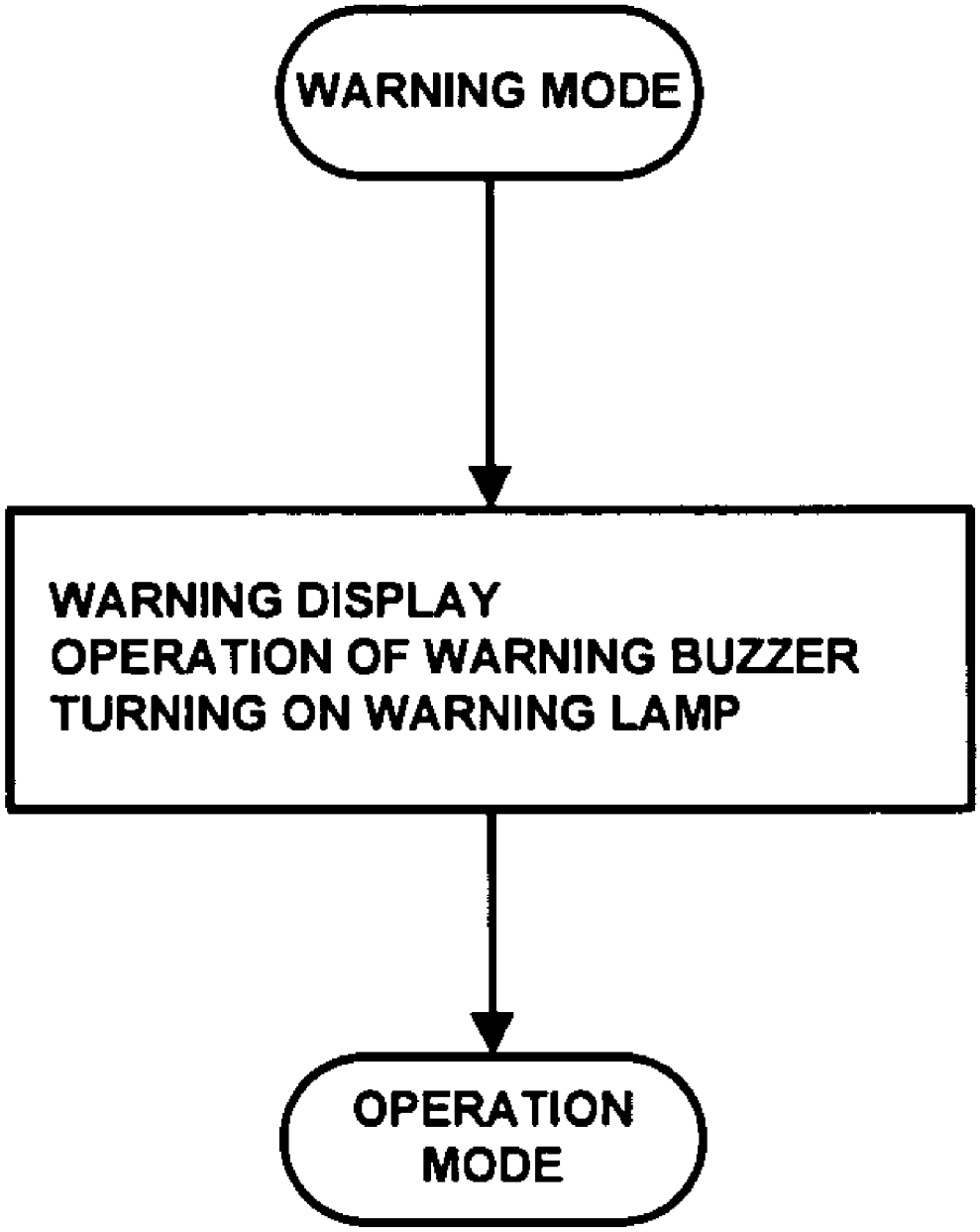
FIG. 3D is a flowchart showing an operation of the internal pressure explosion-proof system in a warning mode according to the first embodiment of the present invention.

Next, a warning mode example is explained with reference to the flowchart shown in FIG. 3D. When the mode of the system shifts from the operation mode to the warning mode, the alarm 9 executes a warning display such as buzzer operation and lamp lighting, and the operation mode is continued.

Figure 4:
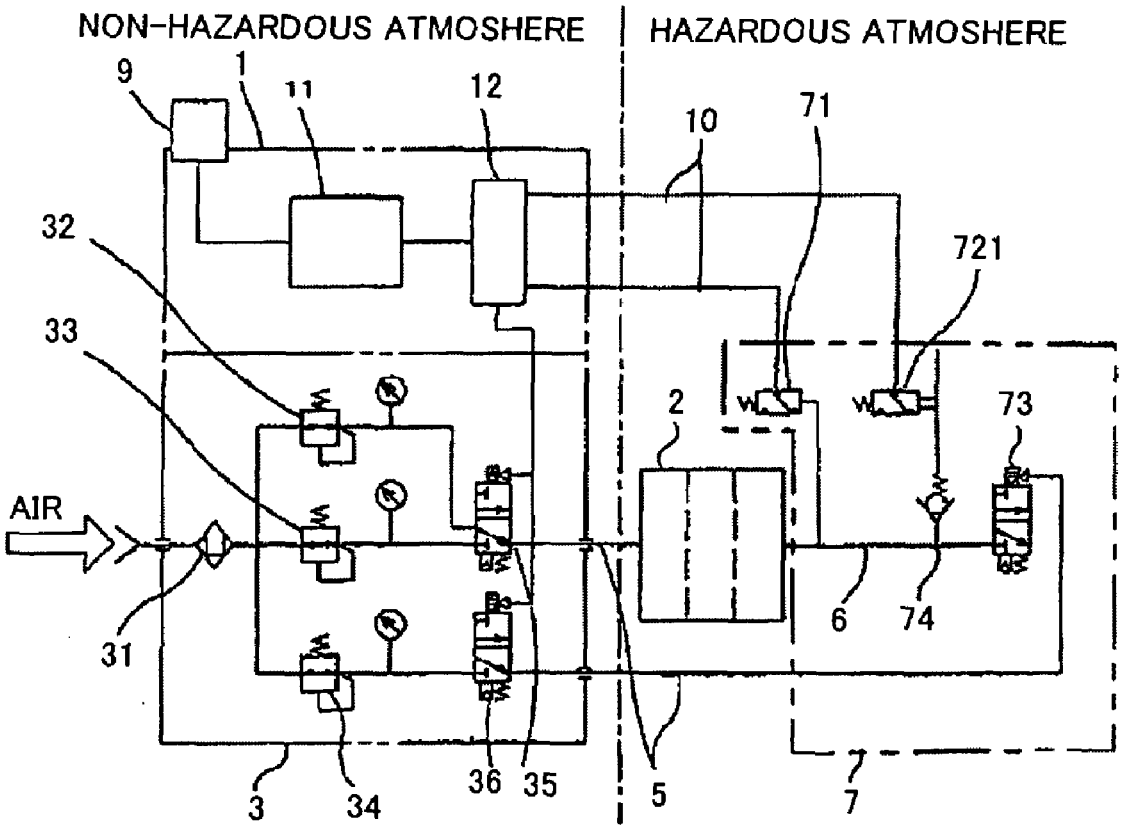
FIG. 4 is block diagram showing an internal pressure explosion-proof system according to a second embodiment of the present invention.

FIG. 4 is a block diagram showing the structure of a second embodiment of the present invention. In FIG. 4, the same reference numerals are allotted to elements corresponding to the elements shown in FIG. 1. In this embodiment, instead of the pressure detector 72 shown in FIG. 1, a flow detector 721 is disposed at the downstream side of the pressure regulating valve 74. When the pressure of the inactive-gas/air flowing through the inactive-gas/air piping 6 becomes higher than the set pressure, the pressure regulating valve 74 is opened and the flow detector 721 detects the inactive-gas/air flowing through the pressure regulating valve 74. The flow detector 721 sends a signal to the control apparatus 1 when the detected flow rate exceeds a preset value. The flow detector 721 is set such that it can detect a small flow rate.

Figure 5:
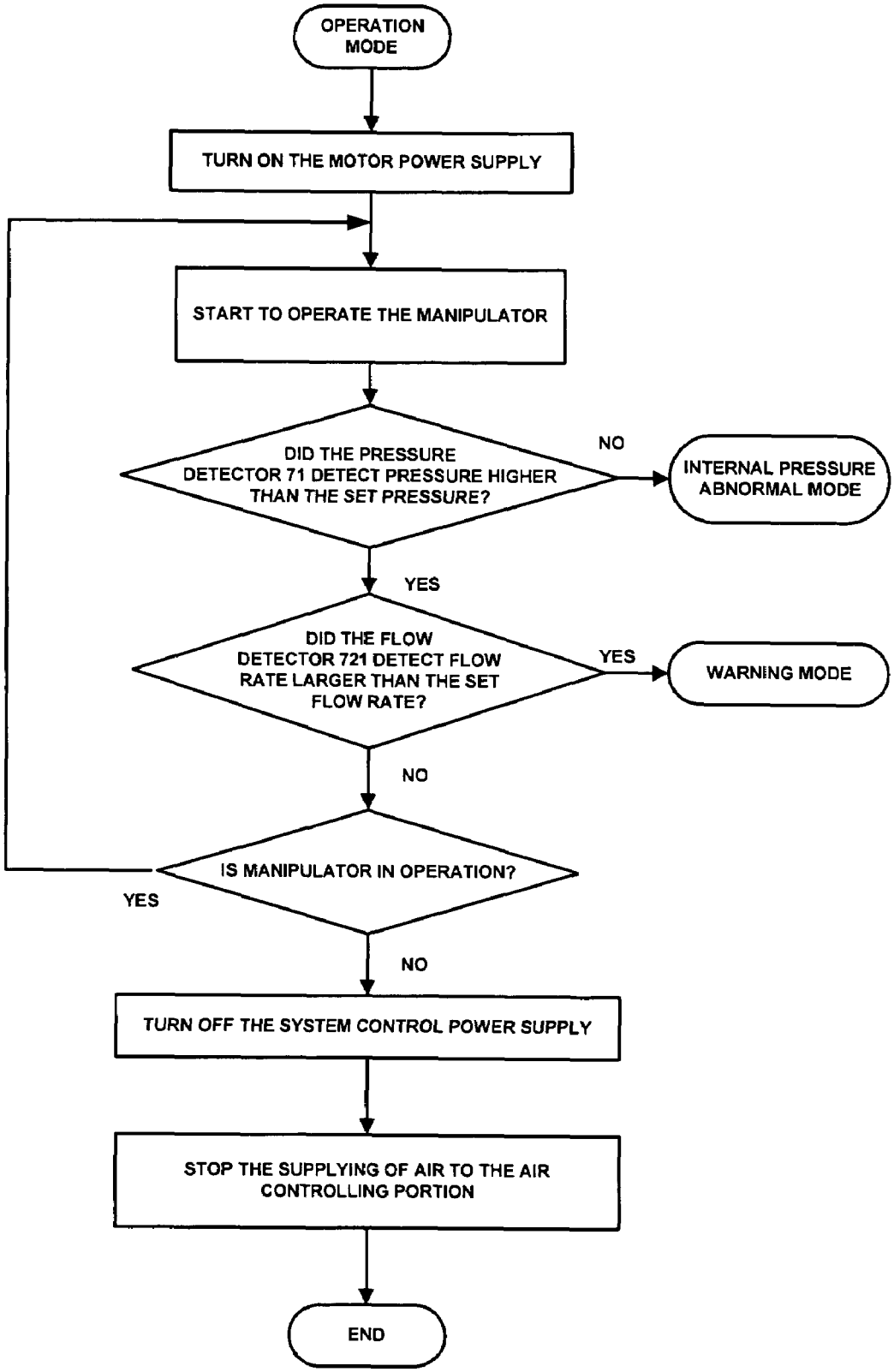
FIG. 5 is a flowchart showing an operation of the internal pressure explosion-proof system according to the second embodiment of the present invention.

FIG. 5 is similar to the operation shown in FIG. 3. However, in FIG. 5, the mode shifts to a warning mode when the flow detector 721 detects the flow rate exceeding the preset value.

Figure 6:
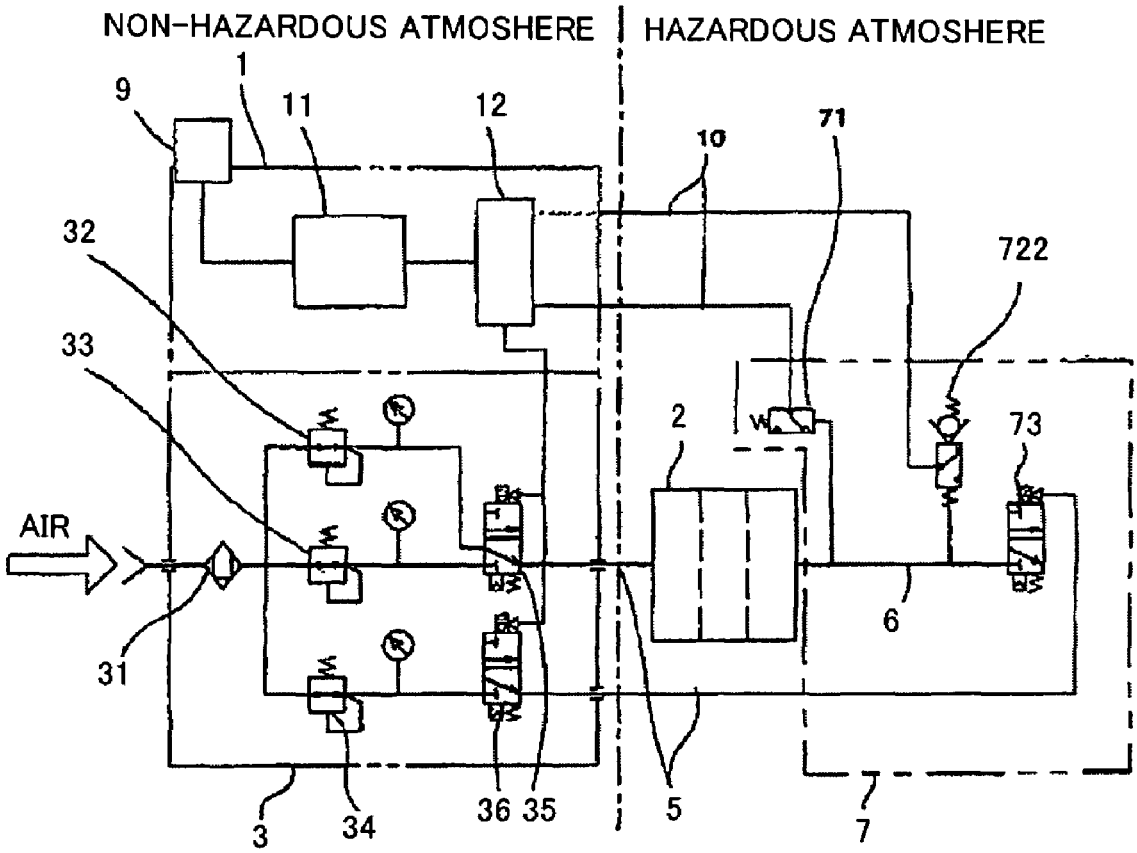
FIG. 6 is a block diagram showing an internal pressure explosion-proof system according to a third embodiment of the present invention.

FIG. 6 is a block diagram showing the structure of a third embodiment of the present invention. In FIG. 6, the same reference numerals are allotted to elements corresponding to the elements shown in FIG. 1. In this embodiment, in place of the pressure detector 72 shown in FIG. 1, the pressure regulating valve 722 with a switch is used. This pressure regulating valve 722 with a switch is opened when the pressure of the inactive-gas/air flowing through the inactive-gas/air piping 6 becomes higher than a set pressure, and the valve 722 releases the inactive-gas/air to the atmosphere. The switch simultaneously sends a signal to the control apparatus 1. The working pressure of the pressure regulating valve 722 with a switch is set to be slightly higher than a normal pressure.

Figure 7:
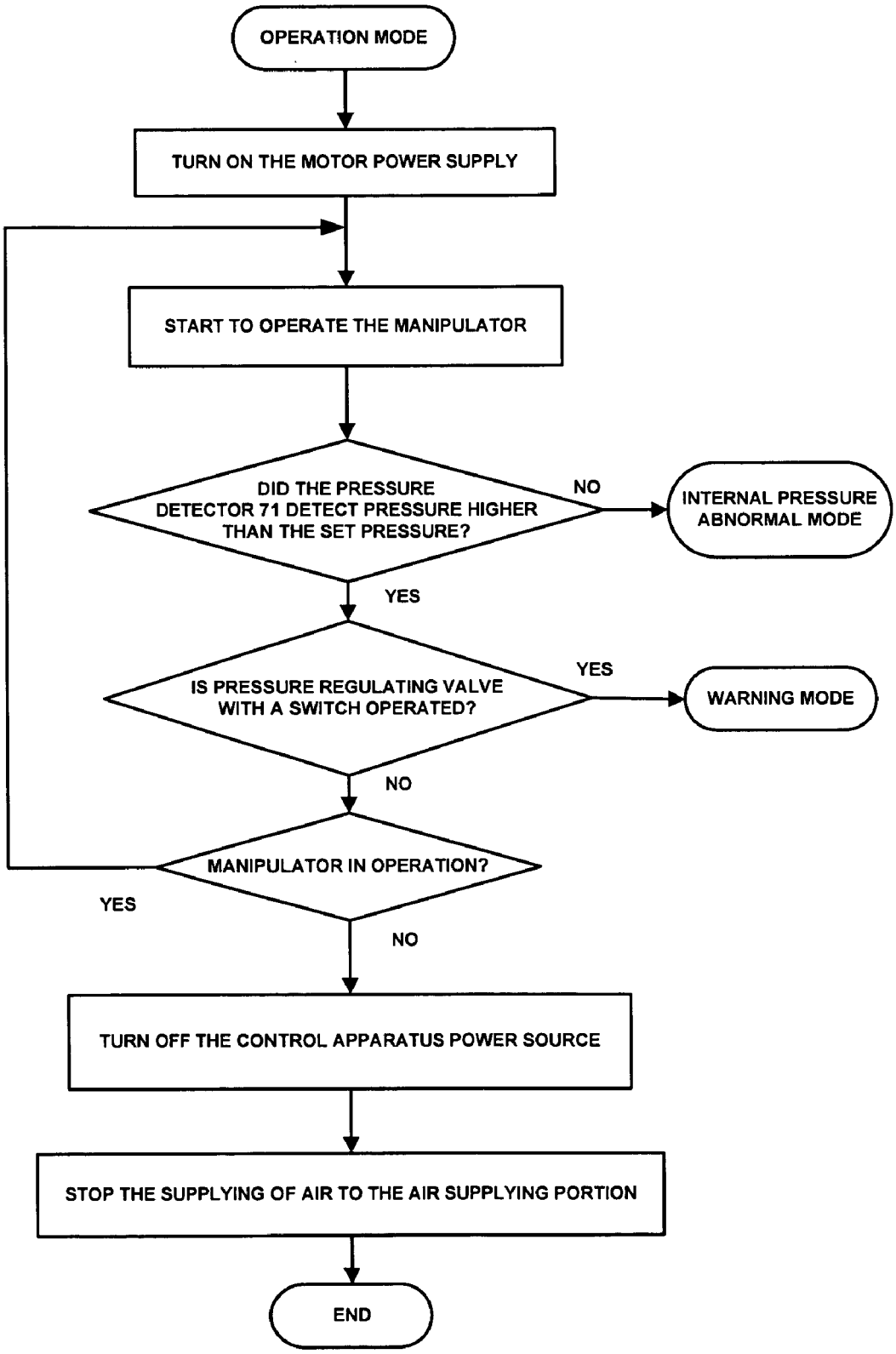
FIG. 7 is a flowchart showing an operation of the internal pressure explosion-proof system according to the third embodiment of the present invention.

FIG. 7 is similar to the operation shown in FIG. 5. However, in FIG. 7, the mode shifts to a warning mode when the pressure regulating valve 722 with a switch is operated.

In each of the above embodiments, when a signal of the high-pressure abnormality detector is sent to the control apparatus 1, it can be configured such that the mode shifts to an internal pressure abnormal mode in place of the warning mode.

A fourth embodiment of the present invention is explained below. Since the structure is similar as in Example 1, the explanation is made with reference to FIG. 1. When the inactive-gas/air supplied to the manipulator 2 becomes higher in pressure than the set pressure of the pressure detector 72 which is a high-pressure abnormality detector 8, the pressure detector 72 sends a signal to the control apparatus 1. The control apparatus 1 makes the alarm 9 perform an abnormal display upon receipt of the signal, and makes the electromagnetic valve 36 operate to open the open valve 73 to thereby release the inactive-gas/air supplied to the manipulator 2 from the inactive-gas/air discharging portion 7. Moreover, the inactive-gas/air supplied to the manipulator 2 becomes higher in pressure than the set pressure of the pressure regulating valve 74, the pressure regulating valve 74 opens to discharge the inactive-gas/air. The set pressure of the pressure detector 72 is set to be slightly higher than a normal pressure. The set pressure of the pressure regulating valve 74 is set to be slightly higher than the set pressure of the pressure detector 72.

Here, for example, because the inactive-gas/air supplied to the manipulator 2 is discharged from the open valve 73, it can be configured such that the pressure regulating valve 74 is omitted. As the secondary effects, the space-saving and cost reduction of the air discharging portion 7 can be realized.

Figure 8:
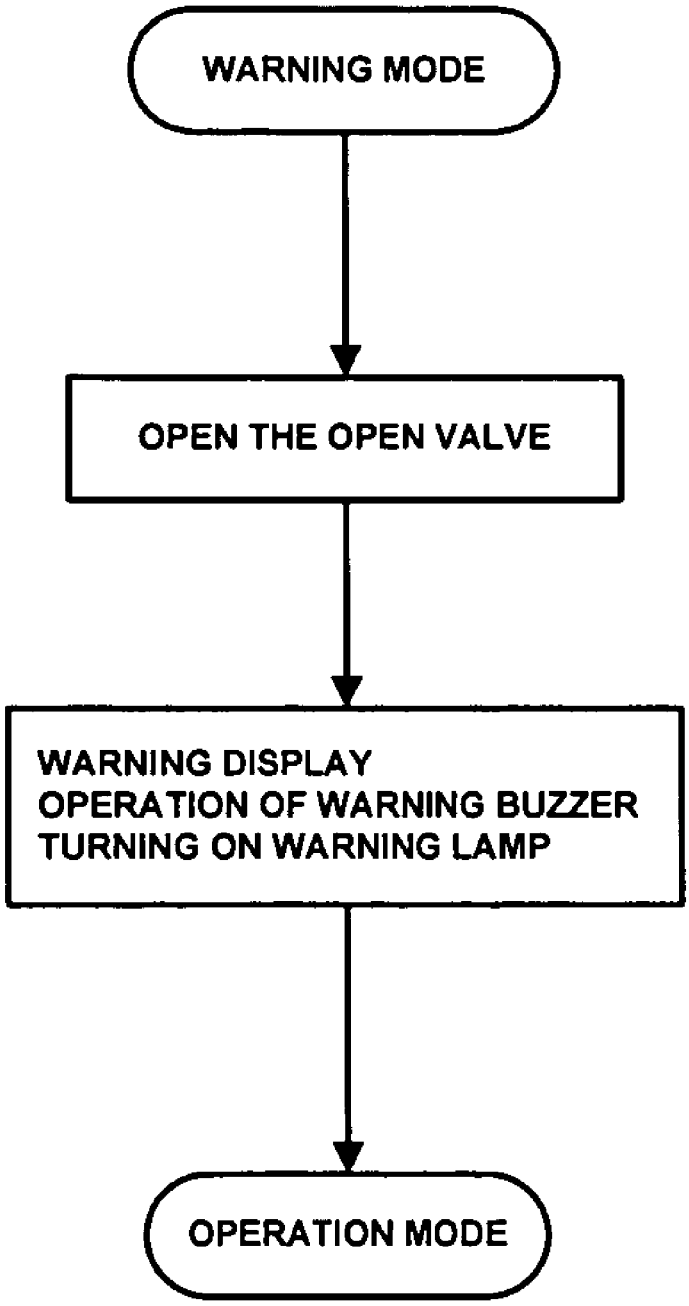
FIG. 8 is a flowchart showing an operation of the internal pressure explosion-proof system in a warning mode according to first to fourth embodiments of the present invention.

FIG. 8 is similar to the operation shown in FIG. 3. However, in FIG. 8, the mode shifts to a warning mode and the open valve 73 is opened when the high-pressure abnormality detector 8 is operated.

A fifth embodiment of the present invention is explained below. Since the structure is the same as in Example 2, the explanation is made with reference to FIG. 4. When the inactive-gas/air supplied to the manipulator 2 becomes high in pressure, the flow detector 721 detects the inactive-gas/air flowing out of the pressure regulating valve 74, and sends a signal to the control apparatus 1. The control apparatus 1 makes the alarm 9 perform an abnormal display in response to the signal, makes the electromagnetic valve 36 operate to open the open valve 73 to release the inactive-gas/air supplied to the manipulator 2 from the air discharging portion 7. The set pressure of the pressure regulating valve 74 is set to be slightly higher than a normal pressure. The flow detector 721 is set so that it can be operated by a small flow rate.

In operation, as shown in FIG. 8, the difference resides in that the mode shifts to a warning mode when the flow detector 721 detects a flow rate larger than a preset value and the open valve 73 is opened.

A sixth embodiment of the present invention is explained below. Since the structure is the same as in Example 3, the explanation is made with reference to FIG. 6. When the inactive-gas/air supplied to the manipulator 2 becomes high in pressure, the pressure regulating valve 722 with a switch opens, and the inactive-gas/air is discharged and a signal is sent to the control apparatus 1. The control apparatus 1 makes the alarm 9 perform an abnormal display in response to the signal and also make the electromagnetic valve 36 operate to open the open valve 73 to thereby discharge the inactive-gas/air supplied to the manipulator 2 from the air discharging portion 7. The set pressure of the pressure regulating valve 722 with a switch is set to be slightly higher than a normal pressure.

In operation, as shown in FIGS. 7 and 8, the mode shifts to a warning mode and the open valve 73 opens when the pressure regulating valve 722 with a switch is operated.

Figure 9:
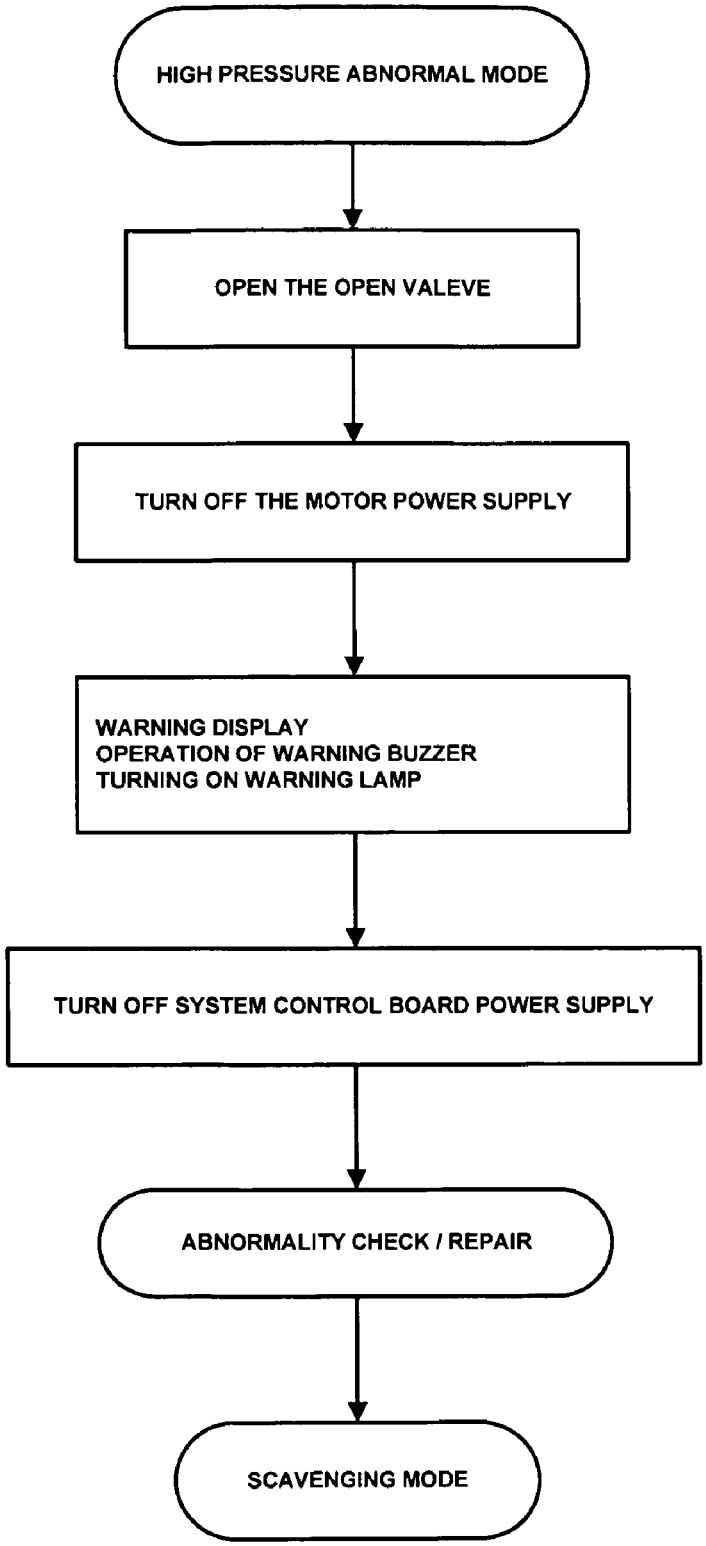
FIG. 9 is a flowchart showing an operation of the internal pressure explosion-proof system in a high pressure abnormality mode according to the present invention.

In the above embodiments 4, 5, and 6, for example, when the signal of the high-pressure abnormality detector is sent to the control apparatus 1 and shifts to a warning mode, it can be configured such that the mode shifts to a high pressure abnormal mode in place of the warning mode. The operation in the high pressure abnormality mode is shown, for example, in the flowchart of FIG. 9.

Although the inactive-gas/air discharging portion 7 is installed in the hazardous atmosphere in the aforementioned six embodiments, it can be configured such that the discharging portion 7 can be installed in a non-hazardous atmosphere.

As explained above, in the aforementioned embodiments, it is configured such that the system can detect the occurrence of abnormality in the inactive-gas/air passages in the system and the excessive internal pressure of the internal pressure explosion-proof mechanism such as a manipulator and the excess of the internal pressure is outputted as information that a person can recognize. When abnormality of the inactive-gas/air apparatus occurs and the internal pressure chamber of the internal pressure explosion-proof mechanism becomes high in pressure, the information is sent to a user, which enables the user to perform the check of the inactive-gas/air apparatus assuredly. Moreover, as a result, it becomes possible to stably operate the robot system having an internal pressure explosion-proof structure.

Although the aforementioned embodiments are directed to a robot system, the present invention can be applied to any system having an internal pressure explosion-proof structure equipped with a means for releasing an excessive internal pressure to an atmosphere via an open valve.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

We claim:

1. An internal pressure explosion-proof system, comprising:

an internal pressure explosion-proof mechanism to be installed in a hazardous atmospher, the internal pressure explosion-proof mechnainsm having an internal pressure chamber to which inactive-gas/air is supplied;

a control apparatus to be installed in a non-hazardous atmosphere to control the internal pressure explosion-proof mechanism;

an inactive-gas/air supplying portion configured to supply inactive-gas/air to the internal pressure explosion-proof mechanism;

an inactive-gas/air discharging portion configured to release the inactive-gas/air discharged from the internal pressure explosion-proof mechanism;

a high-pressure abnormality detector configured to send a signal to the control apparatus when an internal pressure of the internal pressure explosion-proof mechanism becomes higher than a predetermined pressure; and an alarm configured to give warning when the signal of the high-pressure abnormality of the high-pressure abnormality detector is received, wherein the control apparatus makes the alarm generate warning and also makes the inactive-gas/air discharging portion release inactive-gas/air in the internal pressure explosion-proof mechanism when the control apparatus receives the signal of the high-pressure abnormality from the high-pressure abnormality detector, and wherein the internal pressure explosion-proof mechanism is a robot.

2. The internal pressure explosion-proof system according to claim 1, wherein the high-pressure abnormality detector is provided in the discharging portion.

3. The internal pressure explosion-proof system according to claim 1, wherein the alarm is provided in the control apparatus.

4. The internal pressure explosion-proof system according to claim 1, wherein the high-pressure abnormality detector is a pressure detector.

5. The internal pressure explosion-proof system according to claim 1, wherein the high-pressure abnormality detector is a flow detector.

6. The internal pressure explosion-proof system according to claim 1, wherein the high-pressure abnormality detector is a pressure regulating valve equipped with a switch which releases inactive-gas/air and sends a signal when detected pressure reaches a predetermined value or above.

* * * * *